US010068554B2

(12) United States Patent
Arumugam et al.

(10) Patent No.: US 10,068,554 B2
(45) Date of Patent: Sep. 4, 2018

(54) SYSTEMS AND METHODS FOR CONSERVING POWER IN REFRESHING A DISPLAY PANEL

(71) Applicant: QUALCOMM Incorporated, San Diego, CA (US)

(72) Inventors: Panneer Arumugam, San Jose, CA (US); Gopikrishnaiah Andandan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 11 days.

(21) Appl. No.: 15/226,607

(22) Filed: Aug. 2, 2016

(65) Prior Publication Data

US 2018/0040306 A1 Feb. 8, 2018

(51) Int. Cl.
*G09G 5/393* (2006.01)
*G09G 5/395* (2006.01)

(52) U.S. Cl.
CPC ..... *G09G 5/393* (2013.01); *G09G 5/395* (2013.01); *G09G 2330/021* (2013.01); *G09G 2360/121* (2013.01)

(58) Field of Classification Search
CPC .. G09G 5/393; G09G 5/395; G09G 2330/021; G09G 2360/121
USPC ..... 382/162, 173
See application file for complete search history.

(56) References Cited

U.S. PATENT DOCUMENTS 7,586,492 B2 9/2009 Riach et al.
8,279,214 B2 10/2012 Correa et al.
9,236,029 B2 1/2016 Barnhoefer et al.
2006/0001641 A1* 1/2006 Degwekar ..... G09G 3/3406 345/102
2006/0017743 A1* 1/2006 Chan ..... G09G 5/02 345/589
2006/0274937 A1* 12/2006 Jeffrey ..... G06T 5/009 382/169
2008/0079735 A1* 4/2008 Selwan ..... G09G 3/3611 345/505
2008/0079739 A1* 4/2008 Gupta ..... G09G 5/363 345/520
2010/0039414 A1* 2/2010 Bell ..... G09G 3/20 345/207
2010/0277509 A1* 11/2010 Lu ..... G09G 3/344 345/690
2010/0278425 A1* 11/2010 Takemoto ..... G06T 7/10 382/173
2011/0063312 A1* 3/2011 Hong ..... G06T 1/60 345/530

(Continued)

OTHER PUBLICATIONS

International Search Report and Written Opinion—PCT/US2017/034245—ISA/EPO—dated Aug. 2, 2017.

*Primary Examiner* — Jacinta M Crawford
(74) *Attorney, Agent, or Firm* — Austin Rapp & Hardman, P.C.

(57) ABSTRACT

A method for refreshing a display panel is described. The method includes receiving, at the display panel from post-processing hardware, a look-up table (LUT) based on a histogram of image data and a region of interest (ROI) of the image data. The method also includes applying, at the display panel, the LUT to at least a portion of cached data in panel memory to produce modified data. The method further includes refreshing the display panel based on the modified data.

30 Claims, 11 Drawing Sheets

(56) References Cited

U.S. PATENT DOCUMENTS

| | | | | |
|---|---|---|---|---|
| 2014/0240333 | A1 | 8/2014 | Shirota et al. | |
| 2014/0369598 | A1 | 12/2014 | Nilsson et al. | |
| 2015/0269887 | A1* | 9/2015 | Liu | G09G 3/3291 345/212 |
| 2015/0293575 | A1 | 10/2015 | Hampson et al. | |
| 2015/0356946 | A1* | 12/2015 | Sung | G09G 5/06 345/690 |
| 2016/0021384 | A1* | 1/2016 | Croxford | G06T 1/00 375/240.12 |

* cited by examiner

500

SYSTEMS AND METHODS FOR CONSERVING POWER IN REFRESHING A DISPLAY PANEL

TECHNICAL FIELD

The present disclosure relates generally to electronic devices. More specifically, the present disclosure relates to systems and methods for conserving power in refreshing a display panel.

BACKGROUND

In the last several decades, the use of electronic devices has become common. In particular, advances in electronic technology have reduced the cost of increasingly complex and useful electronic devices. Cost reduction and consumer demand have proliferated the use of electronic devices such that they are practically ubiquitous in modern society. As the use of electronic devices has expanded, so has the demand for new and improved features of electronic devices. More specifically, electronic devices that perform new functions and/or that perform functions faster, more efficiently or more reliably are often sought after.

Some electronic devices present images on a display panel. For example, a smartphone may present a user interface, photographs, videos, etc. Presenting images may consume power. As can be observed from this discussion, systems and methods that improve power efficiency of presenting images may be beneficial.

SUMMARY

A method for refreshing a display panel is described. The method includes receiving, at the display panel from post-processing hardware, a look-up table (LUT) based on a histogram of image data and a region of interest (ROI) of the image data. The method also includes applying, at the display panel, the LUT to at least a portion of cached data in panel memory to produce modified data. The method further includes refreshing the display panel based on the modified data.

The method may include receiving the image data at the post-processing hardware from system memory. The method may also include determining, by the post-processing hardware, a histogram based on the image data. The method may further include sending the histogram to an image processing algorithm from the post-processing hardware. The method may additionally include determining, by the image processing algorithm, the LUT. The method may also include receiving the LUT at the post-processing hardware.

The method may include updating, by the display panel, the cached data based on the ROI. The ROI may be provided by a hardware abstraction layer (HAL).

The image data may be a full frame of image data corresponding to a frame after an initial frame. The image data received at the post-processing hardware from the system memory may be the ROI corresponding to a frame after an initial frame. The method may include caching, by the post-processing hardware, the ROI in write back memory.

The histogram may be generated in the write back memory. The method may include caching the histogram in the write back memory. The method may include updating the histogram for a full frame based on the ROI.

The method may include applying, by the post-processing hardware, the LUT to the ROI. The at least the portion of cached data may include a non-ROI region of the cached data.

An electronic device is also described. The electronic device includes post-processing hardware. The electronic device also include a display panel. The display panel is configured to receive, from the post-processing hardware, a look-up table (LUT) based on a histogram of image data and a region of interest (ROI) of the image data. The display panel is also configured to apply the LUT to at least a portion of cached data in panel memory to produce modified data. The display panel is further configured to refresh the display panel based on the modified data.

A computer-program product for refreshing a display panel is also described. The computer-program product includes a non-transitory tangible computer-readable medium with instructions. The instructions include code for causing an electronic device to receive, at the display panel from post-processing hardware, a look-up table (LUT) based on a histogram of image data and a region of interest (ROI) of the image data. The instructions also include code for causing the electronic device to apply, at the display panel, the LUT to at least a portion of cached data in panel memory to produce modified data. The instructions further include code for causing the electronic device to refresh the display panel based on the modified data.

An apparatus is also described. The apparatus includes post-processing means. The apparatus also includes display means. The display means includes means for receiving, from the post-processing means, a look-up table (LUT) based on a histogram of image data and a region of interest (ROI) of the image data, for applying the LUT to at least a portion of cached data in panel memory means to produce modified data, and for refreshing the display means based on the modified data.

DETAILED DESCRIPTION

In some approaches to conserving power, an image processing algorithm (e.g., post-processing algorithm) may enhance contrast and reduce the backlight for a display to save power without affecting the visual quality. The image processing algorithm may work by collecting a histogram for a full frame from post-processing hardware and by generating a look-up table (LUT). This LUT may be provided to post-processing hardware, which may apply the LUT to enhance the contrast of a frame presented on a display.

Other approaches to conserving power may involve partial update. With partial update, the post-processing hardware saves power by updating only a partial frame (e.g., region of interest (ROI) of the frame) to the display panel internal memory. Accordingly, power may be conserved by reducing memory, bus, clock and/or link rate, etc., depending on the ROI. A ROI may be a partial frame (e.g., less than a full frame) of image data. The ROI may include one or more pixels (e.g., a set of pixels) where changes have occurred (e.g., where pixel values have changed) between frames. The ROI may or may not be contiguous. For example, the ROI may include one contiguous set of pixels of an image or may include multiple separate locations of one or more pixels.

Since the image processing algorithm (e.g., post-processing algorithm) may work on a full frame and partial update may work (e.g., only work) on an ROI, these two features have not been concurrently utilized. For example, when image processing algorithms are enabled for full frame processing, the power savings of partial update may not be utilized and vice versa. Some configurations of the systems and methods described herein may enable both approaches to work together for increased power savings (e.g., reduced power consumption).

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

Figure 1:
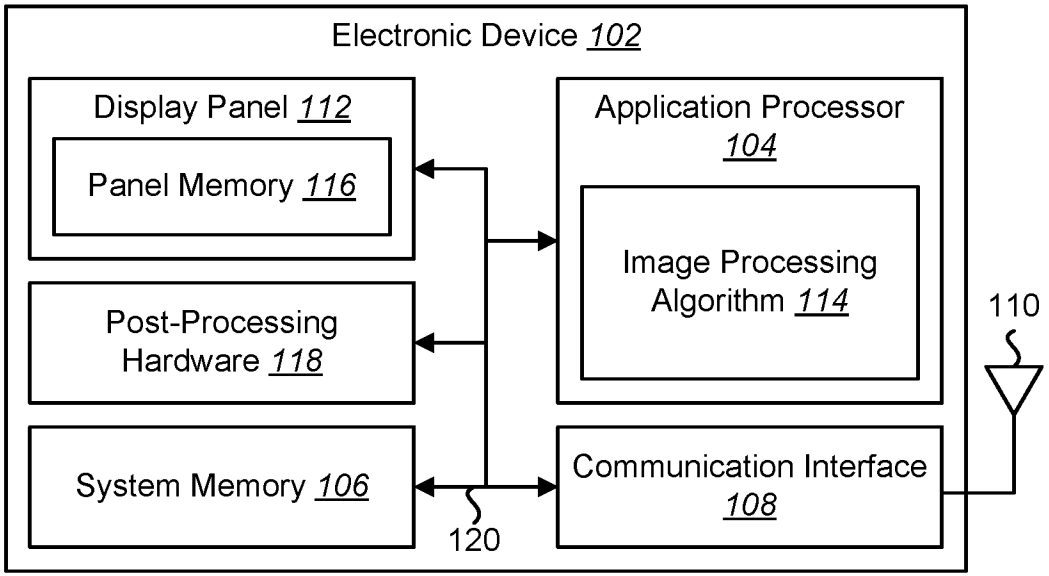
FIG. 1 is a block diagram illustrating one example of an electronic device in which systems and methods for conserving power in refreshing a display panel may be implemented.

FIG. 1 is a block diagram illustrating one example of an electronic device 102 in which systems and methods for conserving power in refreshing a display panel 112 may be implemented. Examples of the electronic device 102 include cellular phones, smartphones, tablet devices, media players, computers (e.g., desktop computers, laptop computers, etc.), televisions, vehicles, cameras, virtual reality devices (e.g., headsets), augmented reality devices (e.g., headsets), mixed reality devices (e.g., headsets), gaming consoles, personal digital assistants (PDAs), set-top boxes, appliances, etc. The electronic device 102 may include one or more components or elements. One or more of the components or elements may be implemented in hardware (e.g., circuitry) or a combination of hardware and software and/or firmware (e.g., a processor with instructions).

In some configurations, the electronic device 102 may include an application processor 104, system memory 106, one or more display panels 112, post-processing hardware 118, and/or a communication interface 108. The application processor 104 may be coupled to (e.g., in electronic communication with) the system memory 106, display panel 112, post-processing hardware 118 and/or communication interface 108. For example, two or more components may be coupled with one or more buses and/or links 120. The one or more buses and/or links 120 may represent one or more couplings between two or more components. The one or more buses and/or links 120 may include one or more separate and/or combined couplings. Examples of a link 120 between post-processing hardware 118 and the display panel 112 may include display serial interface (DSI) and high-definition multimedia interface (HDMI). In addition to or alternatively from DSI and/or HDMI, other types of buses and/or links (e.g., any display interface) may be utilized in accordance with the systems and methods disclosed herein. It should be noted that one or more components may be optional. For example, the communication interface 108 may not be included in some configurations.

The application processor 104 may be a general-purpose single- or multi-chip microprocessor (e.g., an advanced reduced instruction set computing (RISC) machine (ARM)), a special-purpose microprocessor (e.g., a digital signal processor (DSP)), a microcontroller, a programmable gate array, etc. The application processor 104 may be referred to as a central processing unit (CPU). Although just a single application processor 104 is shown in the electronic device 102, in an alternative configuration, a combination of processors (e.g., an ARM and a DSP, etc.) may be used. The electronic device 102 may be configured to implement one or more of the methods disclosed herein.

The system memory 106 may store instructions for performing operations by the application processor 104. The system memory 106 may be any electronic component capable of storing electronic information. The system memory 106 may be embodied as random-access memory (RAM), read-only memory (ROM), magnetic disk storage media, optical storage media, flash memory devices in RAM, on-board memory included with the processor, EPROM memory, EEPROM memory, registers, and so forth, including combinations thereof. One example of system memory 106 is dynamic random-access memory (DRAM).

Data and/or instructions may be stored in the system memory 106. In some configurations, the instructions may be executable by the application processor 104 to implement one or more of the methods and/or portions of the methods (e.g., function(s), step(s), procedure(s), etc.) described herein. Executing the instructions may involve the use of the data that is stored in the system memory 106. When the application processor 104 executes the instructions, various portions of the instructions may be loaded onto the application processor 104, and various pieces of data may be loaded onto the application processor 104.

The application processor 104 may access (e.g., read from and/or write to) the system memory 106. Examples of instructions and/or data that may be stored by the system memory 106 may include image data (e.g., frame data) and/or image processing algorithm 114 instructions, etc.

In some configurations, the electronic device 102 may present a user interface on the display panel 112. For example, the user interface may enable a user to interact with the electronic device 102. For example, the user interface may receive a touch, a mouse click, a gesture and/or some other input indicates a command or request.

The display panel(s) 112 may be integrated into the electronic device 102 and/or may be coupled to the electronic device 102. For example, the electronic device 102 may be a smartphone with an integrated display. In another example, the electronic device 102 may be coupled to one or more remote display panels 112 and/or to one or more remote devices that include one or more display panels 112.

The communication interface 108 may enable the electronic device 102 to communicate with one or more other electronic devices. For example, the communication interface 108 may provide an interface for wired and/or wireless communications. In some configurations, the communication interface 108 may be coupled to one or more antennas 110 for transmitting and/or receiving radio frequency (RF) signals. Additionally or alternatively, the communication interface 108 may enable one or more kinds of wireline (e.g., Universal Serial Bus (USB), Ethernet, etc.) communication. The communication interface 108 may be linked to one or more electronic devices (e.g., routers, modems, switches, servers, etc.). For example, the communication interface 108 may enable network (e.g., personal area network (PAN), local area network (LAN), metropolitan area network (MAN), wide area network (WAN), Internet, and/or public switched telephone network (PSTN), etc.) communications.

In some configurations, multiple communication interfaces 108 may be implemented and/or utilized. For example, one communication interface 108 may be a cellular (e.g., 3G, Long Term Evolution (LTE), CDMA, etc.) communication interface 108, another communication interface 108 may be an Ethernet interface, another communication interface 108 may be a universal serial bus (USB) interface, and yet another communication interface 108 may be a wireless local area network (WLAN) interface (e.g., Institute of Electrical and Electronics Engineers (IEEE) 802.11 interface).

In some configurations, the electronic device 102 may perform one or more of the functions, procedures, methods, steps, etc., described in connection with one or more of FIGS. 2-11. Additionally or alternatively, the electronic device 102 may include one or more of the structures described in connection with one or more of FIGS. 2-11.

As described above, the electronic device 102 may be implemented to include system memory 106 (e.g., DRAM), an application processor 104, post-processing hardware 118, and a display panel 112. The application processor 104 may be configured to perform an image processing algorithm 114 (e.g., a post-processing algorithm). It should be noted that the post-processing hardware 118 may be implemented as a part of the application processor 104 or as separate circuitry. In some configurations, the image processing algorithm 114 may be performed by the application processor 104 (and not the post-processing hardware 118, for example).

The system memory 106 (e.g., DRAM) provides image data (e.g., full-frame data or a region of interest (ROI) (e.g., partial frame data)) to the post-processing hardware 118. The post-processing hardware 118 may receive the image data from the system memory 106. The post-processing hardware 118 may determine a histogram (e.g., a pixel histogram) based on the image data. For example, as the post-processing hardware 118 provides the image data to the display panel 112, the post-processing hardware 118 may generate and/or update the histogram. The histogram may represent a full frame of image data. A full frame of image data may include and/or correspond to all of the pixels in an entire image. The histogram may include and/or indicate a distribution of pixel values. For example, the histogram may indicate numbers of pixels with particular pixel values (e.g., how many pixels there are with particular pixel values in a full frame of image data). It should be noted that a full frame of image data may be provided to (and received by) the display panel 112 for an initial (e.g., first) frame. An initial frame may be a first frame for presentation on the display panel 112 and/or a frame in which all of the pixels values differ from a previous frame.

In some configurations, the post-processing hardware 118 may include and/or may have access to write back memory. The write back memory may be separate from system memory 106 and/or from panel memory 116. The post-processing hardware 118 may cache image data (e.g., may cache a full frame of image data, may update a full frame of cached image data with an ROI, etc.). This may enable the system memory 106 to provide a ROI (instead of a full frame of image data, for example) for one or more frames (e.g., subsequent frames) in some configurations. In some approaches, the write back memory may be updated (utilizing a multiplexer (MUX), for example) while the data is transmitted via a display interface. In cases where a full frame is utilized (for an initial frame, for example), the entire write back memory may be updated. In cases where an ROI is utilized (for a subsequent frame, for example), only a region of write back memory specific to the ROI may be updated. In some configurations, the histogram may be generated from the pixel data of an entire frame in the write back memory when a frame transfer is complete (via a display interface, for example). It should be noted that the write back memory may be optional and may not be included and/or utilized in some configurations and/or approaches.

The post-processing hardware 118 may provide (e.g., send) the histogram to the image processing algorithm 114. As illustrated in FIG. 1, the image processing algorithm 114 may be included in and/or implemented by the application processor 104 in some configurations. In other configurations, the image processing algorithm 114 may be included in and/or implemented by hardware (e.g., another processor) separate from the application processor 104. In yet other configurations, the image processing algorithm 114 may be included in and/or implemented by a combination of hardware blocks.

The image processing algorithm 114 may determine a look-up table (LUT) based on the histogram. One example of the image processing algorithm 114 is a contrast enhancement algorithm. Other examples of the image processing algorithm 114 include a sunlight visibility algorithm and a backlight adjustment algorithm. The LUT may specify a mapping between pixel values. For example, the LUT may specify that pixels with an intensity (e.g., within a range of intensities) may be mapped to pixels with a particular (e.g., different) intensity. In the example of contrast enhancement, the LUT may specify or represent an enhancement (e.g., boost) in contrast. Enhancing the contrast may allow pixel brightness (e.g., a panel backlight) to be decreased, which may conserve power without significantly changing the appearance of the image. For example, the image processing algorithm 114 may specify a brightness setting (e.g., backlight indicator, backlight signal, pixel brightness indicator, etc.) for the display panel 112. The brightness setting may be provided (e.g., sent) to the display panel 112 and may control the display panel backlight and/or brightness for one or more pixels. The LUT may be provided (e.g., sent) to the post-processing hardware 118. The post-processing hardware 118 may receive the LUT.

The post-processing hardware 118 may provide (e.g., send) image data and/or the LUT to the display panel 112. The display panel 112 may receive the image data and/or the LUT. In some configurations, the post-processing hardware 118 may provide (e.g., send) a full frame of image data to the display panel 112 for an initial frame. For one or more subsequent frames, the post-processing hardware 118 may provide (e.g., send) a region of interest (ROI) (e.g., a partial frame of image data) to the display panel 112. It should be noted that in some configurations, the same bus and/or link 120 may be utilized to provide the frame and/or ROI to the display panel 112 as that utilized to provide the frame and/or ROI to the post-processing hardware 118. In other configurations, different buses and/or links 120 may be utilized to provide the frame and/or ROI to the display panel 112 and to provide the frame and/or ROI to the post-processing hardware 118.

In some configurations, the post-processing hardware 118 may apply the LUT to image data (e.g., image data corresponding to the same frame or a subsequent frame of image data) and/or provide the LUT to the display panel 112. For example, the post-processing hardware 118 may apply the LUT to a full frame of image data or to a ROI. For instance, the post-processing hardware 118 may change one or more pixel values of the image data based on the mapping specified by the LUT. The image data (with modified pixel value(s)) may be provided (e.g., sent) to the display panel 112. The display panel 112 may receive the image data.

In some configurations, the post-processing hardware 118 may not apply the LUT to the image data. For example, the post-processing hardware 118 may provide the LUT and the image data (e.g., a full frame of image data or a ROI) to the display panel 112.

The display panel 112 may include panel memory 116. In some configurations, the panel memory 116 may be integrated into the display panel. The panel memory 116 may be memory that is accessible by the display panel 112 for caching and/or storage. The panel memory 116 may be separate from the system memory 106.

The display panel 112 may receive the image data and/or the LUT from the post-processing hardware. For example, the display panel 112 may receive a full frame of image data for an initial frame. The display panel 112 may cache the image data (e.g., full frame of image data for an initial frame) in panel memory 116. In another example, the display panel 112 may receive a ROI and/or may cache the ROI in panel memory 116. For example, the display panel 112 may update the full frame image data to include the updated ROI (e.g., may replace a portion of cached full frame image data with the received ROI). In some configurations, the display panel 112 may cache the LUT in panel memory 116.

The display panel 112 may apply the LUT to at least a portion of cached data (e.g., cached image data from a previous frame and/or a current frame) in panel memory 116. For example, the display panel 112 may apply the LUT to a full frame of cached data. In another example, the display panel 112 may apply the LUT to a portion of the cached data (e.g., to a non-ROI portion of the image data). For instance, in some approaches where the post-processing hardware 118 applies the LUT to the ROI, the display panel 112 may only apply the LUT to the non-ROI portion of the image data. In some approaches, the display panel 112 may apply the LUT to a full frame of image data even though the post-processing hardware has already applied the LUT to the ROI. In these approaches, the LUT application to the ROI may result in no changes for ROI pixels. In some configurations, the display panel 112 may apply the LUT to data (e.g., full frame data, partial frame data, etc.) from a subsequent frame. For example, the LUT may be stored in panel memory 116 and/or may be applied to data (e.g., a full frame or partial frame) corresponding to a subsequent frame (which may be received from post-processing hardware 118, for instance).

Applying the LUT to data (e.g., at least a portion of cached data, cached image data from a previous frame and/or a current frame, and/or image data of a subsequent frame) may produce modified data (e.g., changed data, adapted data, contrast-enhanced data, sunlight tuned data, backlight tuned data, etc.). The modified data may include one or more modified pixel values. In some approaches, the display panel 112 may apply the LUT to the at least a portion of cached data in panel memory 116. The resulting modified data may be stored in the panel memory 116 and/or may be utilized to refresh the display panel 112. For example, refreshing the display panel 112 may include presenting the modified data on the display panel 112. The modified data may exhibit one or more modified attributes in comparison with the original image data. For example, the modified data may exhibit enhanced (e.g., increased) contrast, modified saturation, modified white balance, modified hue, enhanced edges, suppressed noise, etc.

The systems and methods disclosed herein may enable conserving power by reducing memory rate, bus 120 rate, clock rate and/or link rate while still providing image processing (e.g., contrast enhancement) that may rely on a full frame of image data. For example, full frame image data may be cached and/or updated with ROI changes, while full-frame processing may be performed based on cached full frame data.

In some approaches, the post-processing hardware 118 may be configured to provide the LUT and a partial frame (e.g., a ROI, not the full frame, etc.) to the display panel 112. In these configurations, the display panel 112 may be configured to apply the LUT to data (e.g., cached data from a previous frame and/or from a current frame and/or to all or part of the image data). For example, the display panel 112 may include panel memory 116. The display panel 112 may be configured to apply the LUT to the cached data (e.g., image data from a previous frame and/or a current frame) in panel memory 116 and/or to the ROI (e.g., partial frame) received from the post-processing hardware 118. In another example, the post-processing hardware 118 may apply the LUT to a ROI (e.g., partial frame) and send the updated ROI. The display panel 112 may apply the LUT to the remainder of the frame in panel memory 116. In some configurations, on a subsequent (e.g., next) frame refresh, for example, the LUT stored in the panel memory 116 (supplied by the bus and/or link 120, for example) may be applied for the entire frame data that is rendered onto the display panel 112. In some approaches, the LUT stored in the panel memory (that was based on a previous frame) may be applied to some or all image data from a current frame. Additionally or alternatively, the LUT (based on a current frame, for example) may be updated in panel memory and applied to some or all image data from a current frame.

In some approaches, the post-processing hardware 118 may be implemented to include write back memory (not shown in FIG. 1). In these configurations, the system memory 106 (e.g., DRAM) may provide (e.g., send) the ROI (e.g., partial frame) to the post-processing hardware 118. The post-processing hardware 118 may receive the ROI. The post-processing hardware 118 may maintain and/or update the histogram (for the full frame) in the write back memory based on the ROI. The post-processing hardware 118 may provide (e.g., send) the full-frame histogram to the image processing algorithm 114 (e.g., contrast enhancement algorithm). The image processing algorithm 114 may receive the histogram. The image processing algorithm 114 may provide (e.g., send) a LUT to the post-processing hardware 118, which may receive and/or store the LUT in the write back memory. The post-processing hardware 118 may provide (e.g., send) the ROI (e.g., partial frame) and the LUT to the display panel 112. The display panel 112 may receive the ROI. The display panel 112 may be configured to apply the LUT to the image data in panel memory 116 and/or to the ROI provided by the post-processing hardware 118. It should be noted that in some configurations, the post-processing hardware 118 and/or the display panel 112 may apply a LUT derived from a previous frame to all or a portion of a current frame.

Implementing one or more of these approaches may conserve power (e.g., reduce power consumption) by using full-frame processing (e.g., contrast enhancement) based on a partial frame update. For example, some configurations of the systems and methods disclosed herein may conserve power by sending only a partial frame and an LUT (e.g., contrast enhancement LUT) to the display panel from the post-processing hardware. Additionally or alternatively, some configurations of the systems and methods disclosed herein may conserve power by caching image data in write-back memory in the post-processing hardware. One or more of the following aspects may be performed and/or implemented in accordance with one or more configurations of the systems and methods disclosed herein.

In some configurations, the post-processing hardware 118 may operate on full frame image data. The histogram may be determined (e.g., generated) for a full frame by the post-processing hardware 118. The LUT may be applied on full frame image data or partial frame image data in the post-processing hardware 118 path. A hardware abstraction layer (HAL) may provide the ROI. For example, the HAL may detect and/or determine the pixel changes between a previous frame and a current frame. The HAL may select the ROI that includes the pixel changes between a previous frame and a current frame. In some configurations, the HAL may be located on the application processor 104. Additionally or alternatively, the HAL may be located on and/or offloaded to any co-processor based on the implementation. The ROI may be specified by and/or obtained from rendering based on the implementation. The ROI along with the LUT may be sent to the display panel 112. The ROI image data may be updated on the internal panel memory 116. The LUT may be applied on full frame image data cached in internal panel memory 116 before refreshing the display panel 112 (e.g., presenting updated pixel(s)). More detail of some configurations of the systems and methods disclosed herein is given in connection with FIGS. 4-6.

In some configurations, one or more of the following aspects may be performed and/or implemented. The initial frame (e.g., a full update) may be cached in write back memory (by the post-processing hardware 118, for example). The post-processing hardware 118 may work on a ROI (e.g., partial frame) basis. The histogram may be determined (e.g., generated) by the write back memory (e.g., by the post-processing hardware in write back memory) using cached full frame image data. The LUT may be applied on the ROI (e.g., partial frame) in the post-processing hardware 118 path. The HAL may provide (e.g., indicate) the ROI image data. The ROI along with LUT may be sent to the display panel 112. The ROI may be updated on the internal panel memory 116. The LUT may be applied on full frame image data cached in the internal panel memory 116 before refreshing the display panel 112. More detail of some configurations of the systems and methods disclosed herein is given in connection with FIGS. 7-9.

It should be noted that one or more of the elements or components of the electronic device may be combined and/or divided. For example, the post-processing hardware 118 may be integrated into the application processor 104. Additionally or alternatively, the image processing algorithm 114 may be divided into elements or components that perform a subset of the operations thereof.

Figure 2:
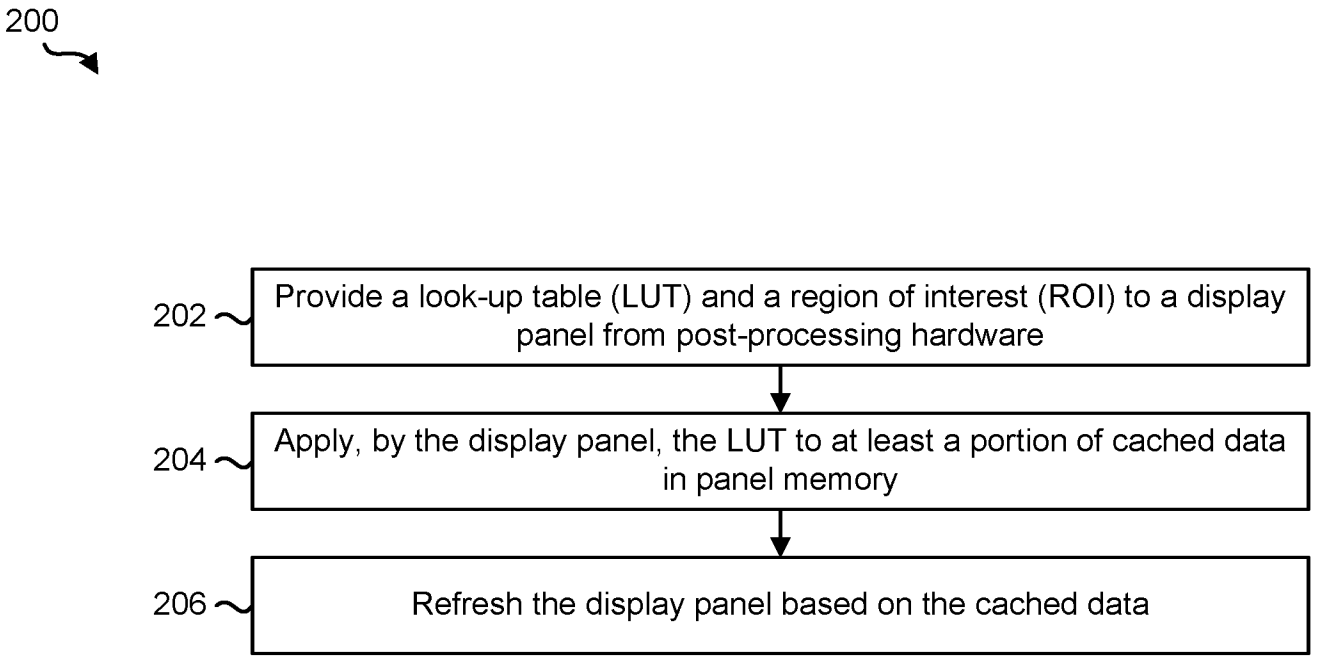
FIG. 2 is a flow diagram illustrating one configuration of a method for conserving power in refreshing a display panel.

FIG. 2 is a flow diagram illustrating one configuration of a method 200 for conserving power in refreshing a display panel. The method 200 may be performed by the electronic device 102. The electronic device 102 may provide 202 a look-up table (LUT) and a region of interest (ROI) to a display panel from post-processing hardware. The display panel may receive the LUT (which may be based on a histogram of image data) and the ROI of the image data. This may be accomplished as described in connection with FIG. 1. For example, after initial frame image data has been cached in panel memory, post-processing hardware may send an ROI to the display panel. This may enable the display panel to update the full frame image data in the panel memory cache. This may avoid sending full frame image data to the display panel for each frame. Accordingly, power may be conserved by reducing bus rate, clock rate, and/or link rate, since an ROI includes less data than a full frame. It should be noted that the ROI may be indicated by a hardware abstraction layer (HAL).

The electronic device 102 (e.g., the display panel) may apply 204 the LUT to at least a portion of cached data (e.g., cached image data from a previous frame and/or a current frame) in panel memory. This may be accomplished as described in connection with FIG. 1. For example, the display panel may apply the LUT to the full frame image data or to a portion of the full frame image data in the panel memory cache. For example, the display panel may replace one or more pixel values of the image data as indicated by the LUT. For instance, the display panel may look up (in the LUT) one or more pixel values that are mapped to one or more pixel values of the image data. Providing the ROI and the LUT to the display panel may allow the performance of full-frame image processing while also allowing for partial frame update. For example, without passing the LUT to the display panel, full frame image processing would be carried out by another hardware block, which may necessitate sending full frame image data to the display panel for each frame. However, in accordance with the systems and methods disclosed herein, both partial frame update and full frame image processing may be performed jointly. In some configurations, applying 204 the LUT to at least a portion of cached data in panel memory may produce modified data as described in connection with FIG. 1. The electronic device 102 (e.g., the display panel) may apply the LUT to one or more portions of a previous frame of image data, one or more portions of a current frame of image data and/or may store the LUT for application to all or a portion of a subsequent frame of image data. For example, all or a portion of a previous frame of image data may be stored in the cache. Accordingly, the LUT may be applied to all or a portion of a previous frame of image data. Additionally or alternatively, the LUT may be applied to all or a portion of a current frame of image data. For example, the cache may be updated with all of a current frame of image data or a ROI from the current frame. Accordingly, the LUT may be applied to all or a portion of a current frame of image data. Additionally or alternatively, the LUT may be stored for application to all or a portion of a subsequent frame. For example, when all or a portion of a subsequent frame is received, the LUT may be applied to the entirety or a portion of the subsequent frame. The cache may be updated with the entirety or the portion of the subsequent frame.

The electronic device 102 may refresh 206 the display panel based on the cached data (e.g., cached image data). This may be accomplished as described above in connection with FIG. 1. For example, the display panel may refresh (e.g., update) one or more pixels presented on the display. In some configurations, the electronic device 102 may refresh 206 the display panel based on the modified data. For example, refreshing the display panel based on the cached data may include presenting modified data as described in connection with FIG. 1.

Figure 3:
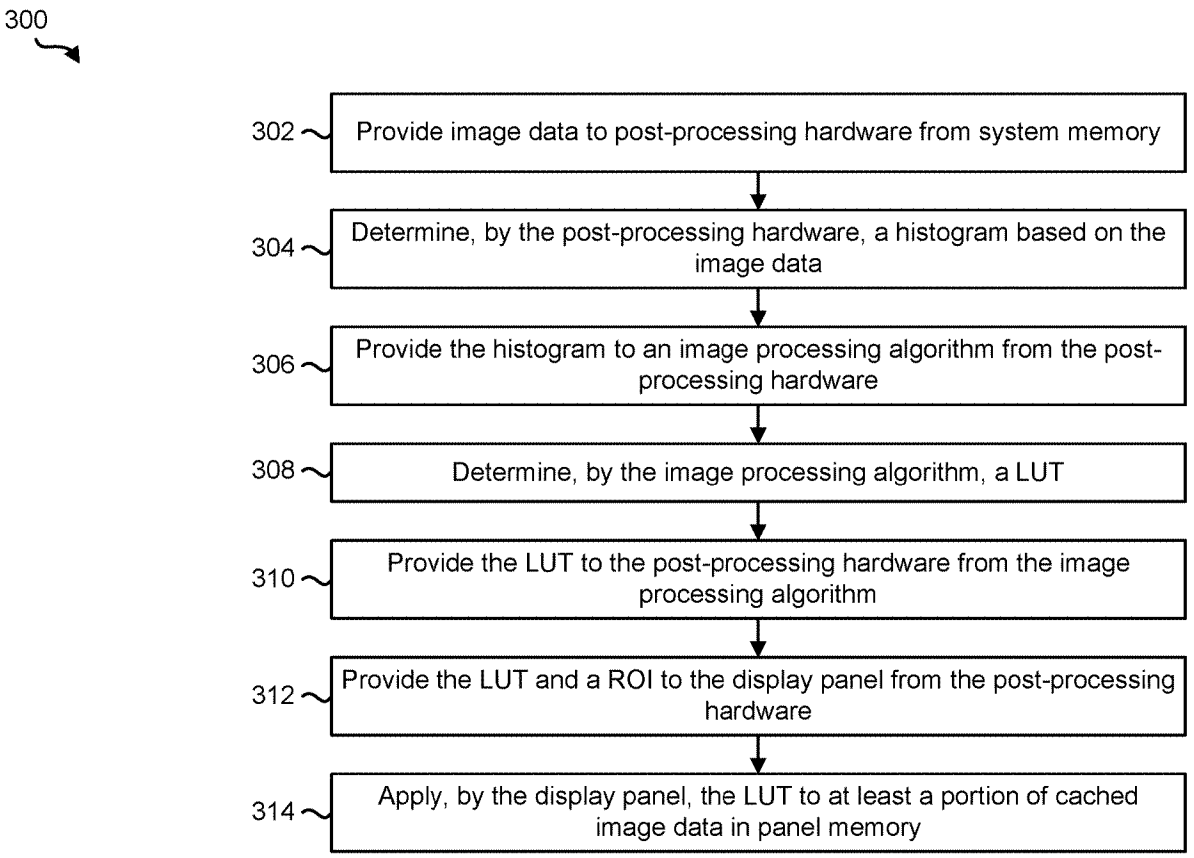
FIG. 3 is a flow diagram illustrating a more specific configuration of a method for conserving power in refreshing a display panel.

FIG. 3 is a flow diagram illustrating a more specific configuration of a method 300 for conserving power in refreshing a display panel. The method 300 may be performed by the electronic device 102.

The electronic device 102 may provide 302 image data to post-processing hardware from system memory. The post-processing hardware may receive the image data from the system memory. This may be accomplished as described in connection with FIG. 1. For example, the system memory may provide 302 a full frame of image data or a ROI to post-processing hardware. In some configurations, the post-processing hardware may cache the image data in write back memory. For example, the post-processing hardware may maintain a full frame of image data in write back memory. For an initial frame, the post-processing hardware may cache full frame image data in some configurations. For one or more subsequent frames, the post-processing hardware may update the cached data (e.g., cached image data) with a ROI received from the system memory.

The electronic device 102 may determine 304, by the post-processing hardware, a histogram based on the image data. This may be accomplished as described in connection with FIG. 1. For example, the post-processing hardware may determine numbers of pixels with particular pixel values. In some configurations, the post-processing hardware may cache the histogram in write back memory. For an initial frame, for example, the post-processing hardware may cache a histogram corresponding to full frame image data. For one or more subsequent frames, the post-processing hardware may update the cached histogram in accordance with the ROI received from the system memory.

The electronic device 102 may provide 306 (e.g., send) the histogram to an image processing algorithm from the post-processing hardware. This may be accomplished as described in connection with FIG. 1. For example, the post-processing hardware may send the histogram to an image processing algorithm, which may be implemented in an application processor and/or a separate block. The histogram may correspond to (e.g., may represent) a full frame of image data.

The electronic device 102 may determine 308, by the image processing algorithm, a LUT. This may be accomplished as described in connection with FIG. 1. For example, the image processing algorithm may determine 308 (e.g., generate, produce, etc.) the LUT based on the histogram. Examples of image processing algorithms may include a sunlight visibility algorithm, a contrast enhancement algorithm, and a backlight adjustment algorithm. A sunlight visibility algorithm may adjust the image (e.g., brightness, contrast, etc.) based on an amount of light in the environment of the electronic device 102. For example, the electronic device 102 may include a light sensor and/or image sensor that may indicate an amount of light (e.g., sunlight) in the environment. The LUT may indicate one or more adjustments to improve image visibility based on the amount of light. The contrast enhancement algorithm may enhance contrast (which may be indicated by the LUT) while reducing backlight to save energy (e.g., battery power). The backlight adjustment algorithm may adjust a display panel 112 backlight based on the image content.

The electronic device 102 may provide 310 the LUT to the post-processing hardware from the image processing algorithm. The post-processing hardware may receive the LUT. This may be accomplished as described in connection with FIG. 1. For example, the image processing algorithm (e.g., an application processor) may provide the LUT to the post-processing hardware (via one or more buses and/or links).

The electronic device 102 may provide 312 the LUT and a ROI to a display panel from post-processing hardware. This may be accomplished as described in connection with one or more of FIGS. 1-2. For example, after initial frame image data has been cached in panel memory, post-processing hardware may send an ROI to the display panel. The ROI may be indicated by a HAL. The ROI may be sent via one or more buses and/or links (e.g., via DSI, HDMI, etc.).

The electronic device 102 (e.g., the display panel) may apply 314 the LUT to at least a portion of cached data (e.g., cached image data from a previous frame and/or a current frame) in panel memory. This may be accomplished as described in connection with one or more of FIGS. 1-2. For example, the display panel may apply the LUT to the full frame image data or to a portion of the full frame image data in the panel memory cache. In some configurations, applying 314 the LUT to at least a portion of cached data in panel memory may produce modified data as described in connection with FIG. 1. The electronic device 102 may refresh the display panel based on the cached data (e.g., cached image data) and/or modified data.

Figure 4:
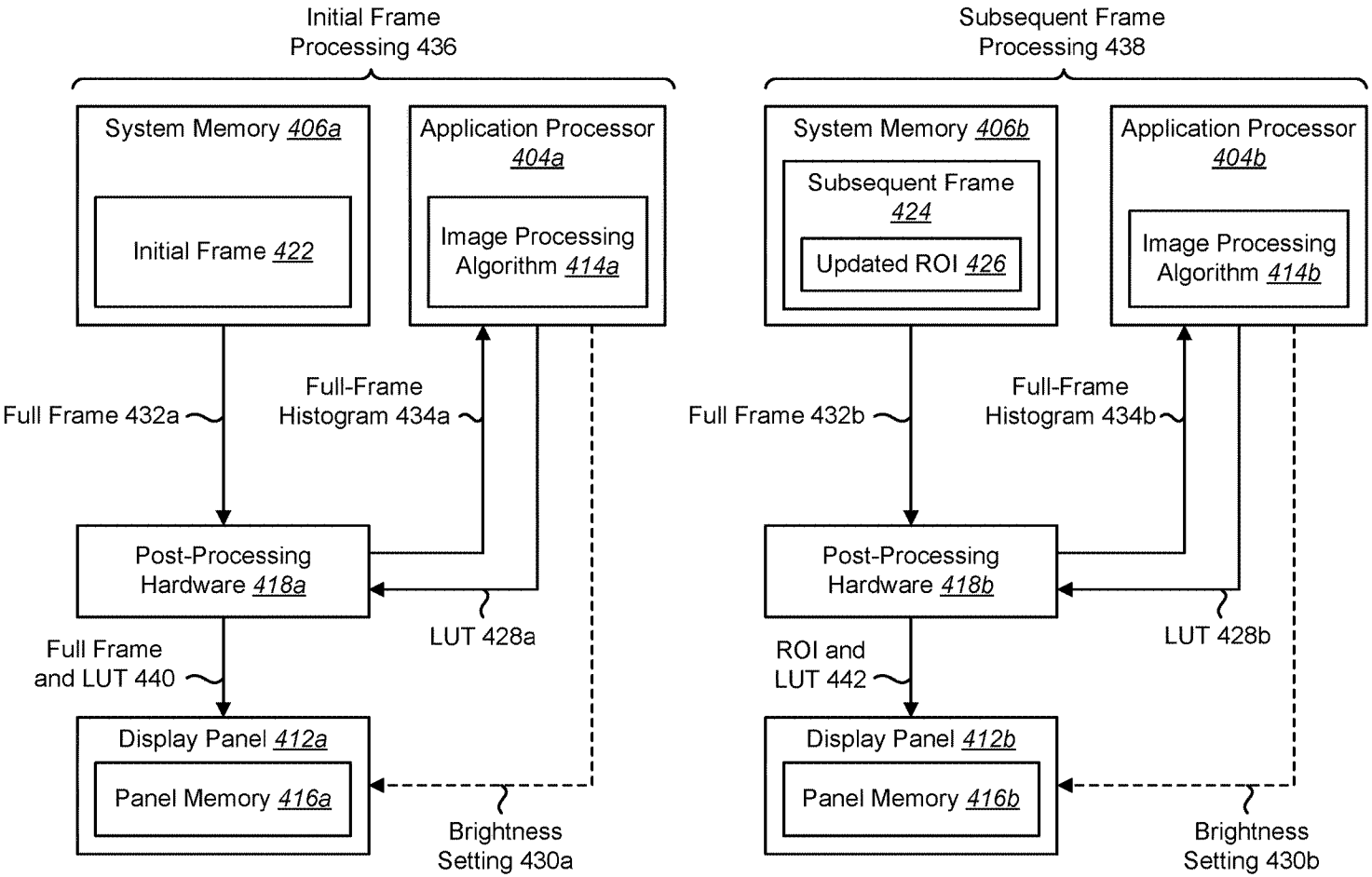
FIG. 4 is a block diagram illustrating an example of an approach for conserving power in refreshing a display panel.

FIG. 4 is a block diagram illustrating an example of an approach for conserving power in refreshing a display panel. FIG. 4 illustrates system memory 406*a-b*, an application processor 404*a-b*, post-processing hardware 418*a-b*, and a display panel 412*a-b*. One or more of the components described in connection with FIG. 4 may be examples of one or more corresponding components described in connection with one or more of FIGS. 1-3. In particular, FIG. 4 illustrates an example of initial frame processing 436 and an example of subsequent frame processing 438. For example, FIG. 4 illustrates the operation of the same components at different times (e.g., for different image frames).

In initial frame processing 436, the system memory 406*a* may include (e.g., store) an initial frame 422. The system memory 406*a* may provide a full frame of image data 432*a* (e.g., the initial frame 422) to the post-processing hardware 418*a*. The post-processing hardware 418*a* may determine a full-frame histogram 434*a* from the full frame of image data 432*a*. The full-frame histogram 434*a* may correspond to and/or represent the full frame of image data 432*a*. The post-processing hardware 418*a* may provide the full-frame histogram 434*a* to the application processor 404*a* (e.g., image processing algorithm 414*a*). It should be noted that the image processing algorithm 414*a-b* may be separate from the application processor 404*a-b* (e.g., implemented in other hardware) in some configurations.

The application processor 404*a* may include and/or implement an image processing algorithm 414*a* (e.g., contrast enhancement algorithm, sunlight visibility algorithm, backlight adjustment algorithm, etc.). The image processing algorithm 414*a* may determine a LUT 428*a* based on the full-frame histogram 434*a*. The LUT 428*a* may be provided to the post-processing hardware 418*a*. In some configurations, the application processor 404*a* (e.g., image processing algorithm 414*a*) may determine (e.g., generate, produce, etc.) a brightness setting 430*a*. The brightness setting 430*a* may be provided to the display panel 412*a*. The post-processing hardware 418*a* may provide the full frame of image data and the LUT 440 to the display panel 412*a*.

The display panel 412*a* may include panel memory 416*a*. The display panel 412*a* may cache the full frame image data and/or the LUT in the panel memory 416*a*. The display panel 412*a* may apply the LUT to cached data (e.g., cached image data). For example, the display panel 412*a* may apply the LUT to a current frame of image data and/or may store the LUT for application to a subsequent frame of image data. Applying the LUT to cached data may result in modified data. In some configurations, the display panel 412*a* may apply the brightness setting 430*a*. For example, the display panel may set (e.g., adjust) a backlight and/or pixel brightness in accordance with the brightness setting 430*a*. The display panel 412*a* may refresh based on the cached data. It can be observed that a full frame of image data may be provided from the system memory 406*a* to the post-processing hardware 418*a* and from the post-processing hardware 418*a* to the display panel 412*a* for an initial frame.

In subsequent frame processing 438, the system memory 406*b* may include (e.g., store) a subsequent frame 424. The subsequent frame 424 may include an updated ROI 426. The updated ROI 426 may include an area of an image that has changed between the initial frame 422 and the subsequent frame 424. The system memory 406*b* may provide the full frame of image data 432*b* (e.g., the subsequent frame 424 including the updated ROI 426) to the post-processing hardware 418*b*. The post-processing hardware 418*b* may determine a full-frame histogram 434*b* from the full frame of image data 432*b*. The full-frame histogram 434*b* may correspond to and/or represent the full frame of image data 432*b*. The post-processing hardware 418*b* may provide the full-frame histogram 434*b* to the application processor 404*b*.

The image processing algorithm 414*b* (included in and/or implemented by the application processor 404*b*) may determine a LUT 428*b* based on the full-frame histogram 434*b*. The LUT 428*b* may be provided to the post-processing hardware 418*b*. The application processor 404*b* (e.g., image processing algorithm 414*a*) may optionally determine (e.g., generate, produce, etc.) a brightness setting 430*b*, which may be provided to the display panel 412*b*. The post-processing hardware 418*b* may provide the ROI of image data and the LUT 442 to the display panel 412*b*. As can be observed, the ROI of image data may be provided to the display panel 412*b* instead of the full frame of image data. This may conserve power by reducing link rate, bus rate, and/or clock rate. Furthermore, the LUT is provided to the display panel. Because the LUT is based on the full-frame histogram, the LUT enables full-frame image processing. This approach may conserve power by providing a ROI of image data while enabling full-frame image processing to be carried out.

The display panel 412*b* may cache the ROI of image data and/or the LUT in the panel memory 416*b*. For example, the display panel 412*b* may update the cached full frame of image data to include the ROI (e.g., to reflect the changes in the image between the previous frame and the current frame). The display panel 412*b* may apply the LUT to cached data (e.g., cached image data). For example, the display panel 412*b* may apply the LUT to one or more portions of a previous frame of image data, one or more portions of a current frame of image data and/or may store the LUT for application to all or a portion of a subsequent frame of image data. Applying the LUT to cached data may result in modified data. In some configurations, the display panel 412*b* may apply the brightness setting 430*b*. The display panel 412*b* may refresh based on the cached data (e.g., cached image data). It can be observed that while a full frame of image data may be provided from the system memory 406*b* to the post-processing hardware 418*b*, a ROI may be provided from the post-processing hardware 418*b* to the display panel 412*b* for a subsequent frame.

Figure 5:
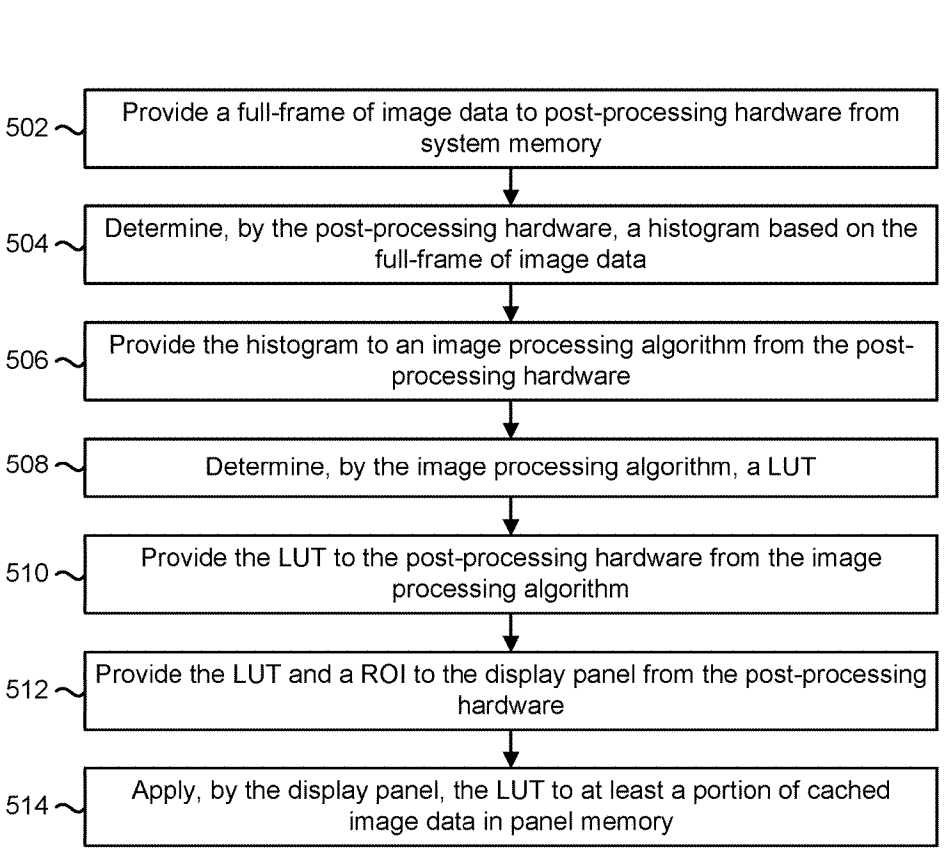
FIG. 5 is a flow diagram illustrating another more specific configuration of a method for conserving power in refreshing a display panel.

FIG. 5 is a flow diagram illustrating another more specific configuration of a method 500 for conserving power in refreshing a display panel. The method 500 may be performed by the electronic device 102 and/or one or more of the components described in connection with FIG. 4.

The electronic device 102 may provide 502 a full frame of image data to post-processing hardware from system memory. This may be accomplished as described in connection with one or more of FIGS. 1 and 3-4.

The electronic device 102 may determine 504, by the post-processing hardware, a histogram based on the full frame of image data. This may be accomplished as described in connection with one or more of FIGS. 1 and 3-4.

The electronic device 102 may provide 506 the histogram to an image processing algorithm from the post-processing hardware. This may be accomplished as described in connection with one or more of FIGS. 1 and 3-4.

The electronic device 102 may determine 508, by the image processing algorithm (e.g., post-processing algorithm), a LUT. This may be accomplished as described in connection with one or more of FIGS. 1 and 3-4.

The electronic device 102 may provide 510 the LUT to the post-processing hardware from the image processing algorithm. This may be accomplished as described in connection with one or more of FIGS. 1 and 3-4.

The electronic device 102 may provide 512 the LUT and a ROI to a display panel from post-processing hardware. This may be accomplished as described in connection with one or more of FIGS. 1-4. The ROI may be indicated by a HAL.

The electronic device 102 (e.g., the display panel) may apply 514 the LUT to at least a portion of cached data (e.g., cached image data from a previous frame and/or a current frame) in panel memory. This may be accomplished as described in connection with one or more of FIGS. 1-4. The electronic device 102 may refresh the display panel based on the cached data (e.g., cached image data) and/or modified data.

Figure 6:
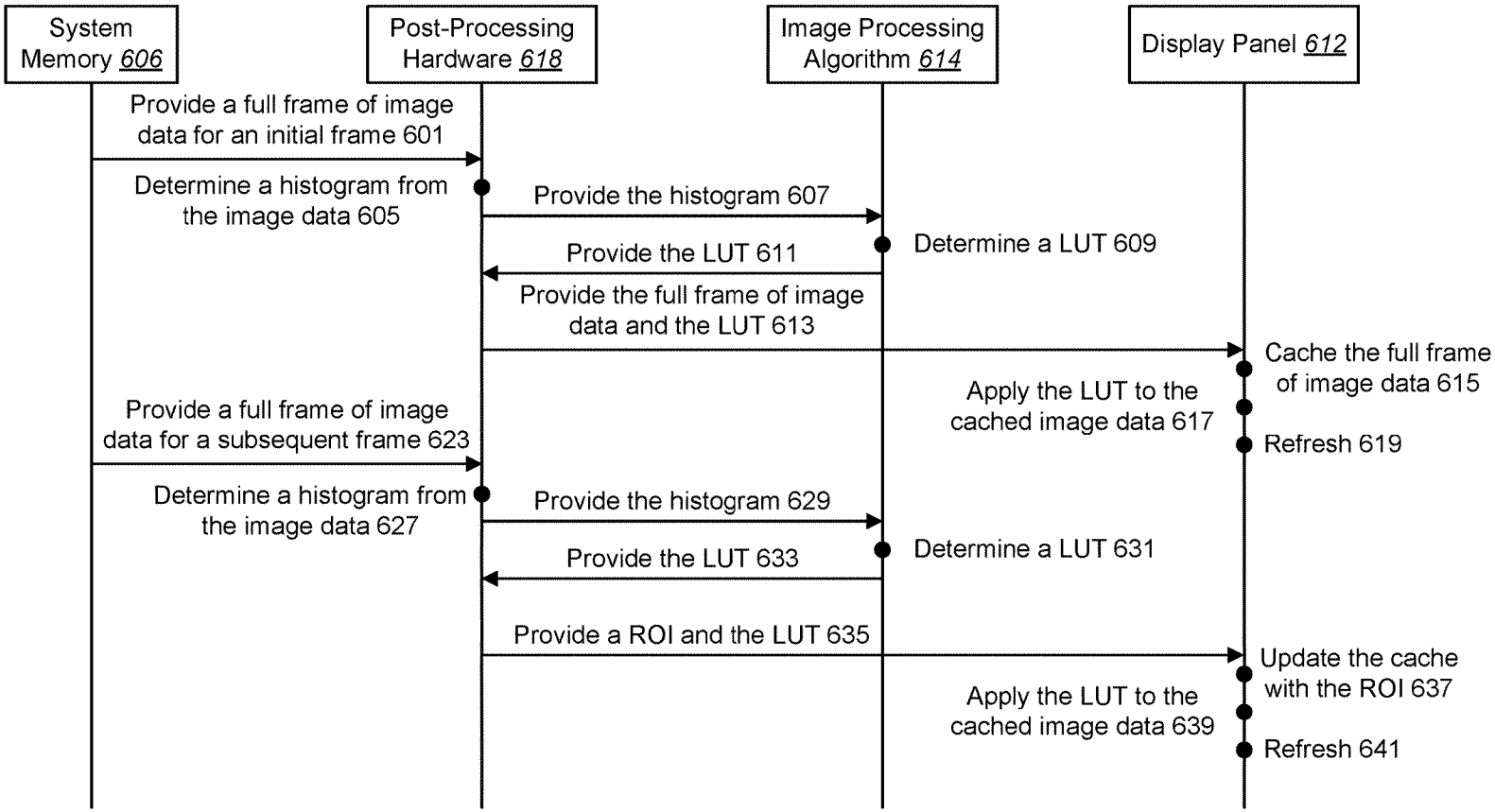
FIG. 6 is a thread diagram illustrating an example of conserving power in refreshing a display panel.

FIG. 6 is a thread diagram illustrating an example of conserving power in refreshing a display panel. In particular, FIG. 6 illustrates interactions between the system memory 606, post-processing hardware 618, an image processing algorithm 614, and a display panel 612 in accordance with one approach of the systems and methods disclosed herein. The components described in connection with FIG. 6 may be examples of corresponding components described in connection with one or more of FIGS. 1-5.

The system memory 606 may provide a full frame of image data for an initial frame 601 to the post-processing hardware 618. The post-processing hardware 618 may determine (e.g., generate) a histogram from the full frame of image data 605. The post-processing hardware 618 may provide the histogram 607 to the image processing algorithm 614.

The image processing algorithm 614 may determine a LUT 609 from the histogram. The LUT may indicate a mapping between pixel values for the full frame. The image processing algorithm 614 may provide the LUT 611 to the post-processing hardware 618. In some configurations, the post-processing hardware 618 may apply the LUT to the image data (e.g., the full frame image data).

The post-processing hardware 618 may provide the full frame of image data and the LUT 613 to the display panel 612. The display panel 612 may cache the full frame of image data 615 in panel memory. In some configurations, the display panel 612 may apply the LUT to the cached data (e.g., to the full frame of image data). The display panel 612 may refresh 619.

The system memory 606 may provide a full frame of image data for a subsequent frame 623 to the post-processing hardware 618. The post-processing hardware 618 may determine (e.g., generate) a histogram from the full frame of image data 627. The post-processing hardware 618 may provide the histogram 629 to the image processing algorithm 614.

The image processing algorithm 614 may determine a LUT 631 from the histogram. The LUT may indicate a mapping between pixel values for the full frame (e.g., the full frame of image data for the subsequent frame). The image processing algorithm 614 may provide the LUT 633 to the post-processing hardware 618.

The post-processing hardware 618 may provide a ROI and the LUT 635 to the display panel 612. The display panel 612 may update the cache with the ROI 637. The display panel 612 may apply the LUT to the cached data (e.g., cached image data) 639. The display panel 612 may refresh 641.

Figure 7:
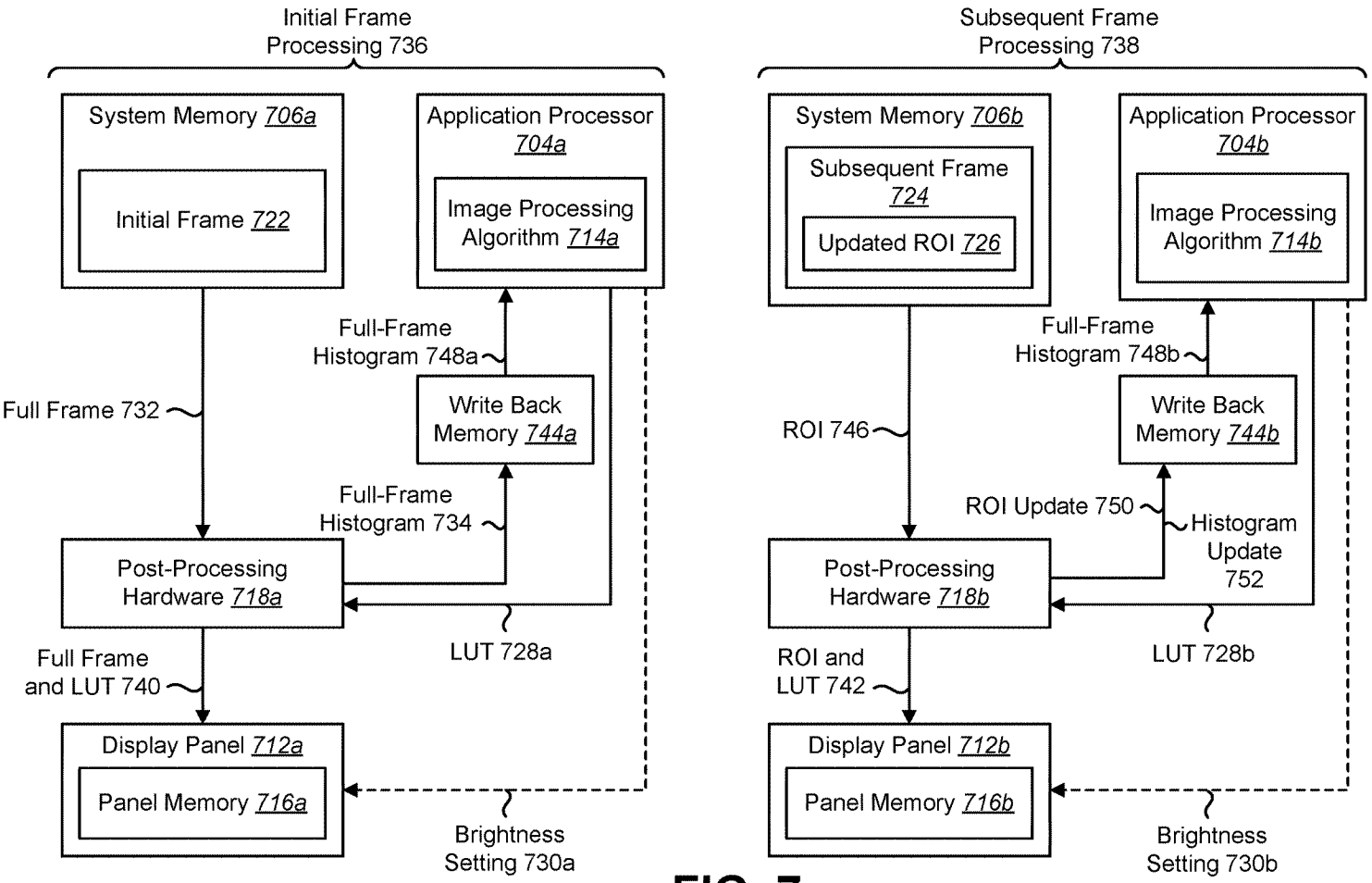
FIG. 7 is a block diagram illustrating an example of another approach for conserving power in refreshing a display panel.

FIG. 7 is a block diagram illustrating an example of another approach for conserving power in refreshing a display panel. FIG. 7 illustrates system memory 706*a-b*, an application processor 704*a-b*, post-processing hardware 718*a-b*, write back memory 744*a-b*, and a display panel 712*a-b*. One or more of the components described in connection with FIG. 7 may be examples of one or more corresponding components described in connection with one or more of FIGS. 1-3. In particular, FIG. 7 illustrates another example of initial frame processing 736 and another example of subsequent frame processing 738. For example, FIG. 7 illustrates the operation of the same components at different times (e.g., for different image frames).

In initial frame processing 736, the system memory 706*a* may include (e.g., store) an initial frame 722. The system memory 706*a* may provide a full frame of image data 732 (e.g., the initial frame 722) to the post-processing hardware 718*a*. The post-processing hardware 718*a* may determine a full-frame histogram 734 from the full frame of image data 732. The full-frame histogram 734 may correspond to and/or represent the full frame of image data 732. The post-processing hardware 718*a* may cache the full-frame histogram 734 in write back memory 744*a*. The write back memory 744*a* may be included in (e.g., integrated into) the post-processing hardware 718*a*. The post-processing hardware 718*a* (e.g., the write back memory 744*a*) may provide the full-frame histogram 748*a* to the application processor 704*a* (e.g., image processing algorithm 714*a*). It should be noted that the image processing algorithm 714*a-b* may be separate from the application processor 704*a-b* (e.g., implemented in other hardware) in some configurations.

The application processor 704*a* may include and/or implement an image processing algorithm 714*a* (e.g., contrast enhancement algorithm, sunlight visibility algorithm, backlight adjustment algorithm, etc.). The image processing algorithm 714*a* may determine a LUT 728*a* based on the full-frame histogram 748*a*. The LUT 728*a* may be provided to the post-processing hardware 718*a*. In some configurations, the application processor 704*a* (e.g., image processing algorithm 714*a*) may determine (e.g., generate, produce, etc.) a brightness setting 730*a*. The brightness setting 730*a* may be provided to the display panel 712*a*. The post-processing hardware 718*a* may provide the full frame of image data and the LUT 740 to the display panel 712*a*.

The display panel 712*a* may include panel memory 716*a*. The display panel 712*a* may cache the full frame image data and/or the LUT in the panel memory 716*a*. The display panel 712*a* may apply the LUT to cached data (e.g., cached image data). For example, the display panel 712*a* may apply the LUT to a current frame of image data and/or may store the LUT for application to a subsequent frame of image data. Applying the LUT to cached data may result in modified data. In some configurations, the display panel 712*a* may apply the brightness setting 730*a*. For example, the display panel may set (e.g., adjust) a backlight and/or pixel brightness in accordance with the brightness setting 730*a*. The display panel 712*a* may refresh based on the cached data (e.g., cached image data). It can be observed that a full frame of image data may be provided from the system memory 706*a* to the post-processing hardware 718*a* and from the post-processing hardware 718*a* to the display panel 712*a* for an initial frame.

In subsequent frame processing 738, the system memory 706*b* may include (e.g., store) a subsequent frame 724. The subsequent frame 724 may include an updated ROI 726. The updated ROI 726 may include one or more pixels (e.g., a region) of an image that has changed between the initial frame 722 and the subsequent frame 724. The system memory 706*b* may provide the ROI 746 (e.g., the updated ROI 726) to the post-processing hardware 718*b*. As can be observed, the ROI 746 of image data may be provided to the post-processing hardware 718*b* instead of the full frame of image data. This may conserve power by reducing memory rate (e.g., system memory 706 rate), link rate, bus rate, and/or clock rate. For example, while a full frame of image data 732 may be provided from the system memory 706*a* to the post-processing hardware 718*a* for an initial frame, a ROI 746 may be provided from the post-processing hardware 718*b* to the display panel 712*b* for a subsequent frame.

The post-processing hardware 718*b* may provide an ROI update 750 to the write back memory 744*b*. For example, the post-processing hardware 718*b* may update the cached full-frame image data in the write back memory 744*b*. For instance, the post-processing hardware 718*b* may replace a portion of cached pixel data (from a previous frame) with ROI pixel data in the ROI update 750. The post-processing hardware 718*b* may determine a histogram update 752 based on the ROI. For example, the post-processing hardware 718*b* may determine a partial histogram update or a full histogram update from the updated image data (e.g., full frame of image data) cached in the write back memory. Updating the histogram may result in a full-frame histogram 748*b*. For example, the full-frame histogram 748*b* may correspond to and/or represent a full frame of image data. The post-processing hardware 718*b* (e.g., the write back memory 744*b*) may provide the full-frame histogram 748*b* to the application processor 704*b* (e.g., the image processing algorithm 714*b*). Caching and updating the full-frame of image data in the write back memory 744*b* based on the ROI 746 may enable full-frame image processing while reducing bus rate, link rate, clock rate, memory rate, etc. For example, the image processing algorithm 714*b* may operate on a full-frame histogram 748*b* even though a full frame of image data is not provided from the system memory 706*b* for each frame.

The image processing algorithm 714*b* (included in and/or implemented by the application processor 704*b*) may determine a LUT 728*b* based on the full-frame histogram 748*b*. The LUT 728*b* may be provided to the post-processing hardware 718*b*. The application processor 704*b* (e.g., image processing algorithm 714*a*) may optionally determine (e.g., generate, produce, etc.) a brightness setting 730*b*, which may be provided to the display panel 712*b*. The post-processing hardware 718*b* may provide the ROI of image data and the LUT 742 to the display panel 712*b*. As can be observed, the ROI of image data may be provided to the display panel 712*b* instead of the full frame of image data. This may conserve power by reducing link rate, bus rate, and/or clock rate. Furthermore, the LUT is provided to the display panel. Because the LUT is based on the full-frame histogram, the LUT enables full-frame image processing. This approach may conserve power by providing a ROI of image data while enabling full-frame image processing to be carried out.

The display panel 712*b* may cache the ROI of image data and/or the LUT in the panel memory 716*b*. For example, the display panel 712*b* may update the cached full frame of image data to include the ROI (e.g., to reflect the changes in the image between the previous frame and the current frame). The display panel 712*b* may apply the LUT to cached data (e.g., cached image data). For example, the display panel 712*b* may apply the LUT to one or more portions of a previous frame of image data, one or more portions of a current frame of image data and/or may store the LUT for application to all or a portion of a subsequent frame of image data. Applying the LUT to cached data may result in modified data. In some configurations, the display panel 712*b* may apply the brightness setting 730*b*. The display panel 712*b* may refresh based on the cached data (e.g., cached image data). It can be observed that while a full frame of image data may be provided from the post-processing hardware 718*a* to the display panel 712*a* for an initial frame, a ROI may be provided from the post-processing hardware 718*b* to the display panel 712*b* for a subsequent frame.

Figure 8:
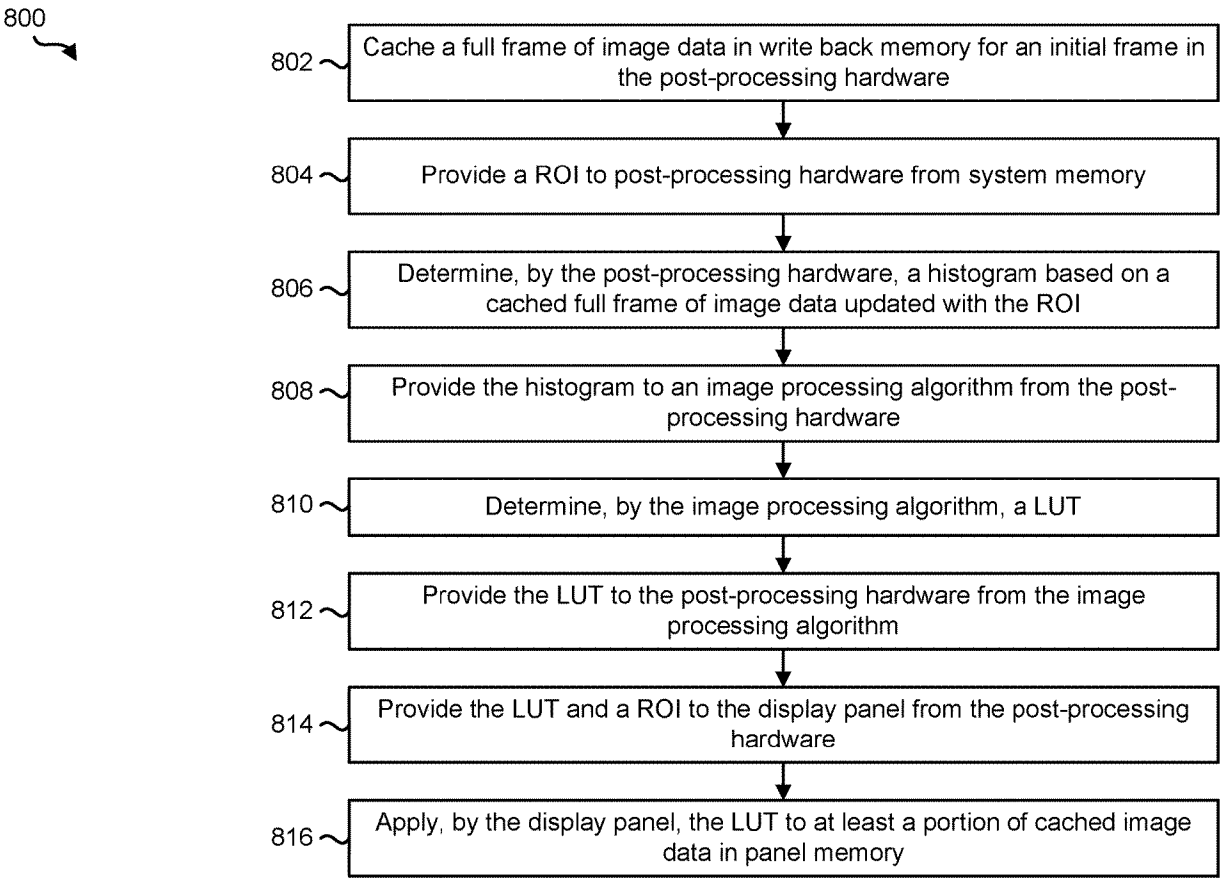
FIG. 8 is a flow diagram illustrating another more specific configuration of a method for conserving power in refreshing a display panel.

FIG. 8 is a flow diagram illustrating another more specific configuration of a method 800 for conserving power in refreshing a display panel. The method 800 may be performed by the electronic device 102 and/or one or more of the components described in connection with FIG. 7.

The electronic device 102 may cache a full frame of image data in write back memory for an initial frame. This may be accomplished as described in connection with one or more of FIGS. 1, 3, and 7.

The electronic device 102 may provide 804 a ROI to post-processing hardware from system memory. This may be accomplished as described in connection with one or more of FIGS. 1, 3, and 7.

The electronic device 102 may determine 806, by the post-processing hardware, a histogram based on the cached full frame of image data, where the cached full frame of image data is updated with the ROI. This may be accomplished as described in connection with one or more of FIGS. 1, 3, and 7. For example, the post-processing hardware may update the cached full frame of image data in write back memory with the ROI. The post-processing hardware may determine the histogram based on the updated full frame of image data cached in the write back memory.

The electronic device 102 may provide 808 the histogram to an image processing algorithm from the post-processing hardware. This may be accomplished as described in connection with one or more of FIGS. 1, 3, and 7. For example, the post-processing hardware (e.g., the write back memory) may provide the histogram to the image processing algorithm.

The electronic device 102 may determine 810, by the image processing algorithm (e.g., post-processing algorithm), a LUT. This may be accomplished as described in connection with one or more of FIGS. 1 and 3-7.

The electronic device 102 may provide 812 the LUT to the post-processing hardware from the image processing algorithm. This may be accomplished as described in connection with one or more of FIGS. 1 and 3-7. In some configurations, the post-processing hardware may apply the LUT to the ROI. In other configurations, the post-processing hardware may not apply the LUT to the ROI.

The electronic device 102 may provide 814 the LUT and a ROI to a display panel from post-processing hardware. This may be accomplished as described in connection with one or more of FIGS. 1-7. The ROI may be indicated by a HAL.

The electronic device 102 (e.g., the display panel) may apply 816 the LUT to at least a portion of cached data (e.g., cached image data from a previous frame and/or a current frame) in panel memory. This may be accomplished as described in connection with one or more of FIGS. 1-7. The electronic device 102 may refresh the display panel based on the cached data (e.g., cached image data).

Figure 9:
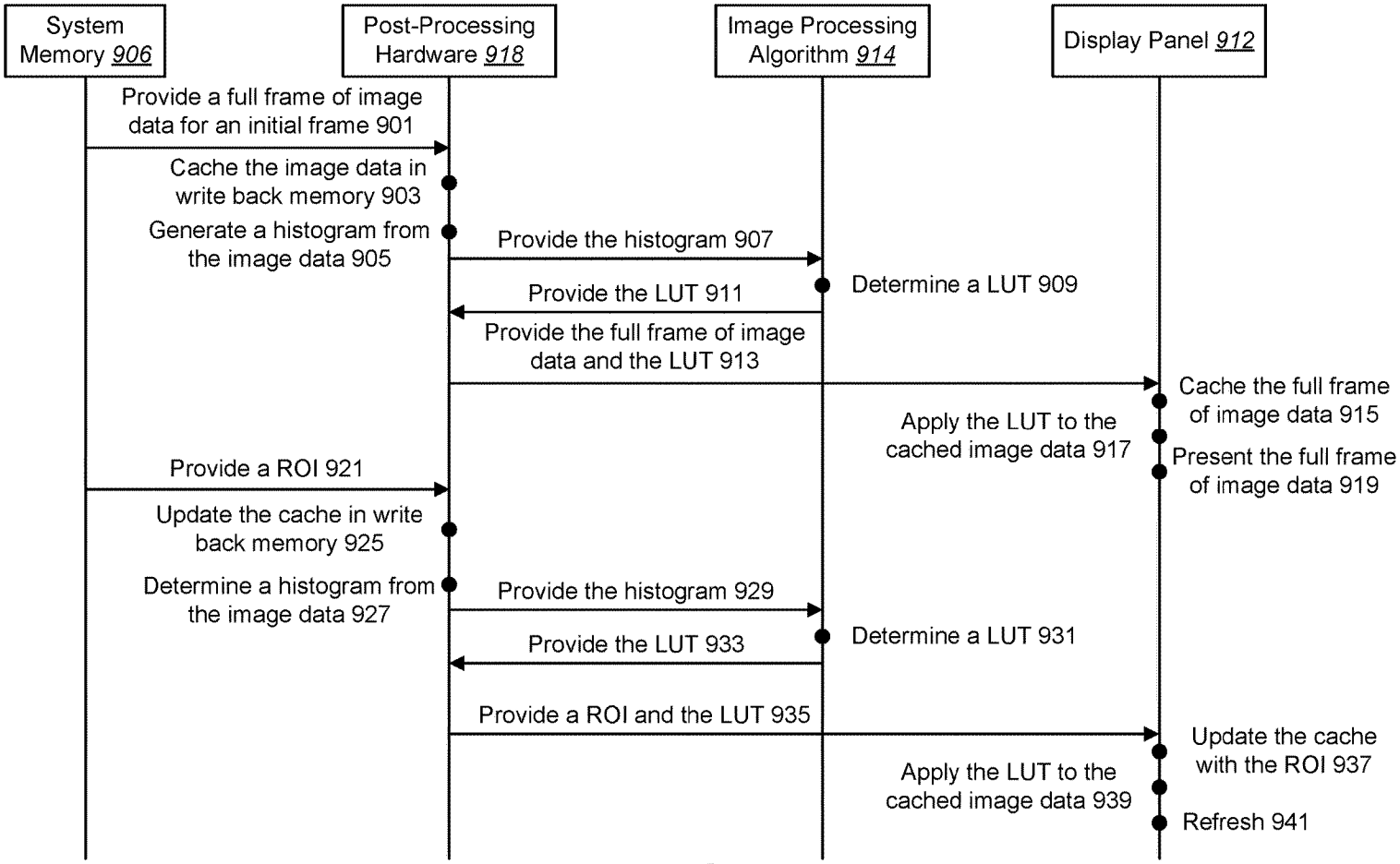
FIG. 9 is a thread diagram illustrating another example of conserving power in refreshing a display panel.

FIG. 9 is a thread diagram illustrating another example of conserving power in refreshing a display panel. In particular, FIG. 9 illustrates interactions between the system memory 906, post-processing hardware 918, an image processing algorithm 914, and a display panel 912 in accordance with another approach of the systems and methods disclosed herein. The components described in connection with FIG. 9 may be examples of corresponding components described in connection with one or more of FIGS. 1-3 and 7-8.

The system memory 906 may provide a full frame of image data for an initial frame 901 to the post-processing hardware 918. The post-processing hardware 918 may cache the image data in write back memory 903. The post-processing hardware 918 may determine (e.g., generate) a histogram from the full frame of image data 905. In some configurations, the post-processing hardware 918 may cache the histogram in write back memory. The post-processing hardware 918 may provide the histogram 907 to the image processing algorithm 914.

The image processing algorithm 914 may determine a LUT 909 from the histogram. The LUT may indicate a mapping between pixel values for the full frame. The image processing algorithm 914 may provide the LUT 911 to the post-processing hardware 918. In some configurations, the post-processing hardware 918 may apply the LUT to the image data (e.g., the full frame image data).

The post-processing hardware 918 may provide the full frame of image data and the LUT 913 to the display panel 912. The display panel 912 may cache the full frame of image data 915 in panel memory. In some configurations, the display panel 912 may apply the LUT to the cached data (e.g., the full frame of image data). The display panel 912 may refresh 919.

The system memory 906 may provide a ROI 921 for a subsequent frame to the post-processing hardware 918. The post-processing hardware 918 may update the cache in write back memory 925. For example, the post-processing hardware 918 may update the full frame of image data in write back memory based on the ROI. The post-processing hardware 918 may determine (e.g., generate) a histogram from the image data 927 (e.g., may update the histogram based on the ROI and/or may determine a histogram from the updated full frame of image data in the write back memory). The post-processing hardware 918 (e.g., the write back memory) may provide the histogram 929 to the image processing algorithm 914.

The image processing algorithm 914 may determine a LUT 931 from the histogram. The LUT may indicate a mapping between pixel values for the full frame (e.g., the full frame of image data for the subsequent frame). The image processing algorithm 914 may provide the LUT 933 to the post-processing hardware 918.

The post-processing hardware 918 may provide a ROI and the LUT 935 to the display panel 912. The display panel 912 may update the cache with the ROI 937. The display panel 912 may apply the LUT to the cached data (e.g., cached image data) 939. The display panel 912 may refresh 941.

Figure 10:
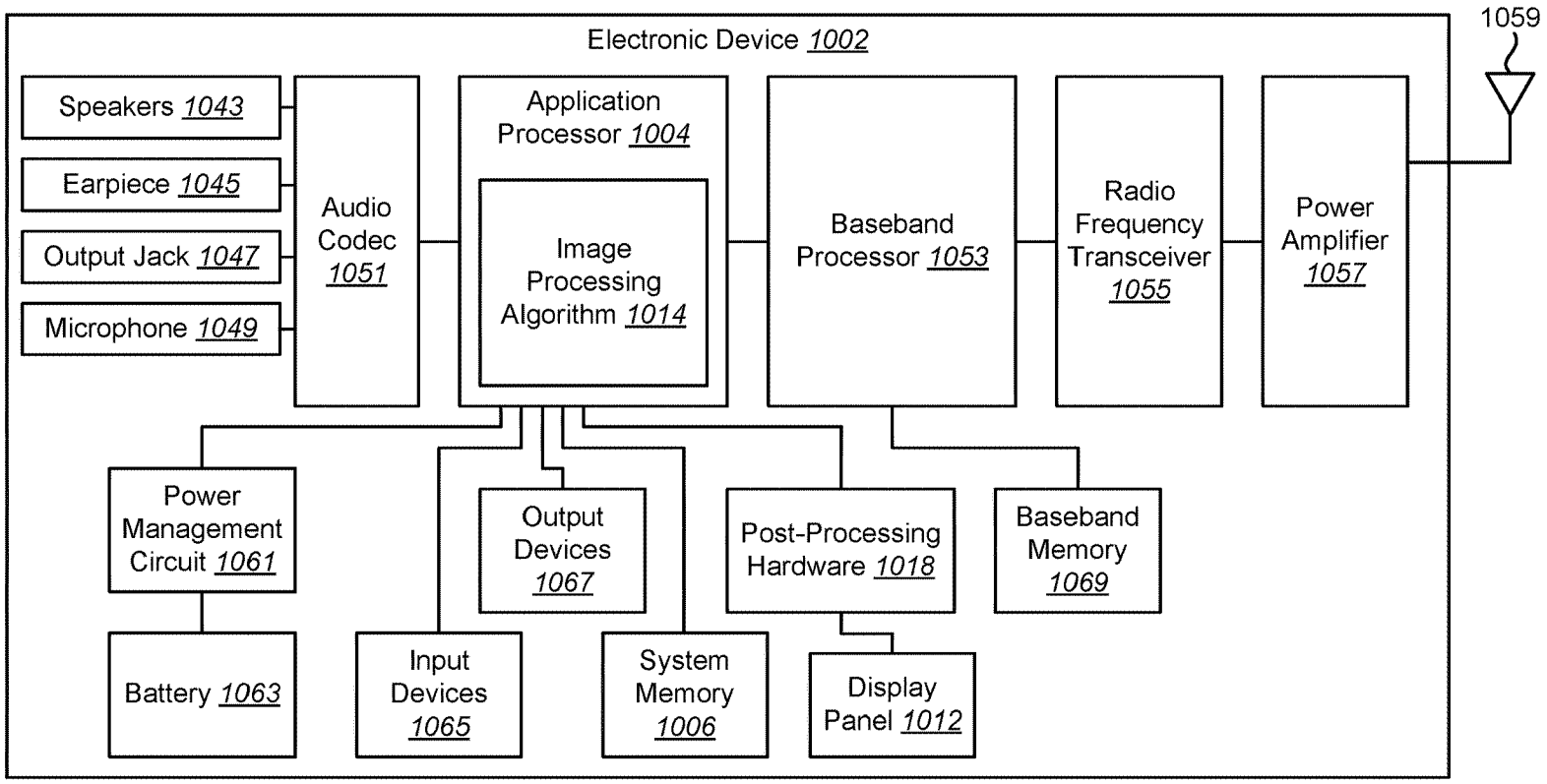
FIG. 10 is a block diagram illustrating one configuration of an electronic device in which systems and methods for conserving power in refreshing a display panel may be implemented.

FIG. 10 is a block diagram illustrating one configuration of an electronic device 1002 in which systems and methods for conserving power in refreshing a display panel 1012 may be implemented. The electronic device 1002 illustrated in FIG. 10 may be an example of one or more of the electronic devices described herein. The electronic device 1002 may perform one or more of the methods 200, 300, 500, 800 described herein. The electronic device 1002 may include an application processor 1004. The application processor 1004 generally processes instructions (e.g., runs programs) to perform functions on the electronic device 1002. In some configurations, the application processor 1004 may include an image processing algorithm 1014. The image processing algorithm 1014 may be an example of one or more of the image processing algorithms 114, 414, 614, 714, 914 described herein. In some configurations, the image processing algorithm 1014 may be implemented separately from the application processor 1004.

The application processor 1004 may be coupled to an audio coder/decoder (codec) 1051. The audio codec 1051 may be used for coding and/or decoding audio signals. The audio codec 1051 may be coupled to at least one speaker 1043, an earpiece 1045, an output jack 1047, and/or at least one microphone 1049. The speakers 1043 may include one or more electro-acoustic transducers that convert electrical or electronic signals into acoustic signals. For example, the speakers 1043 may be used to play music or output a speakerphone conversation, etc. The earpiece 1045 may be another speaker or electro-acoustic transducer that can be used to output acoustic signals (e.g., speech signals) to a user. For example, the earpiece 1045 may be used such that only a user may reliably hear the acoustic signal. The output jack 1047 may be used for coupling other devices to the electronic device 1002 for outputting audio, such as headphones. The speakers 1043, earpiece 1045, and/or output jack 1047 may generally be used for outputting an audio signal from the audio codec 1051. The at least one microphone 1049 may be an acousto-electric transducer that converts an acoustic signal (such as a user's voice) into electrical or electronic signals that are provided to the audio codec 1051.

The application processor 1004 may also be coupled to a power management circuit 1061. One example of a power management circuit 1061 is a power management integrated circuit (PMIC), which may be used to manage the electrical power consumption of the electronic device 1002. The power management circuit 1061 may be coupled to a battery 1063. The battery 1063 may generally provide electrical power to the electronic device 1002. For example, the battery 1063 and/or the power management circuit 1061 may be coupled to at least one of the elements included in the electronic device 1002.

The application processor 1004 may be coupled to at least one input device 1065 for receiving input. Examples of input devices 1065 include infrared sensors, image sensors, accelerometers, touch sensors, keypads, etc. The input devices 1065 may allow user interaction with the electronic device 1002. The application processor 1004 may also be coupled to one or more output devices 1067. Examples of output devices 1067 include printers, projectors, screens, haptic devices, etc. The output devices 1067 may allow the electronic device 1002 to produce output that may be experienced by a user.

The application processor 1004 may be coupled to system memory 1006. The system memory 1006 may be any electronic device that is capable of storing electronic information. Examples of system memory 1006 include double data rate synchronous dynamic random-access memory (DDRAM), synchronous dynamic random-access memory (SDRAM), flash memory, etc. The system memory 1006 may provide storage for the application processor 1004. For instance, the system memory 1006 may store data and/or instructions for the functioning of programs that are run on the application processor 1004.

The application processor 1004 may be coupled to post-processing hardware 1018, which may be coupled to a display panel 1012. The post-processing hardware 1018 may be a hardware block that is used to generate images on the display panel 1012. For example, the post-processing hardware 1018 may translate instructions and/or data from the application processor 1004 into images that can be presented on the display panel 1012. Examples of the display panel 1012 include liquid crystal display (LCD) panels, light emitting diode (LED) panels, cathode ray tube (CRT) displays, plasma displays, etc. In some configurations, the post-processing hardware 1018 may be implemented as part of (e.g., integrated into) the application processor 1004. The post-processing hardware 1018 may include write back memory in some configurations. The display panel 1012 may include panel memory in some configurations.

The application processor 1004 may be coupled to a baseband processor 1053. The baseband processor 1053 generally processes communication signals. For example, the baseband processor 1053 may demodulate and/or decode received signals. Additionally or alternatively, the baseband processor 1053 may encode and/or modulate signals in preparation for transmission.

The baseband processor 1053 may be coupled to baseband memory 1069. The baseband memory 1069 may be any electronic device capable of storing electronic information, such as SDRAM, DDRAM, flash memory, etc. The baseband processor 1053 may read information (e.g., instructions and/or data) from and/or write information to the baseband memory 1069. Additionally or alternatively, the baseband processor 1053 may use instructions and/or data stored in the baseband memory 1069 to perform communication operations.

The baseband processor 1053 may be coupled to a radio frequency (RF) transceiver 1055. The RF transceiver 1055 may be coupled to a power amplifier 1057 and one or more antennas 1059. The RF transceiver 1055 may transmit and/or receive radio frequency signals. For example, the RF transceiver 1055 may transmit an RF signal using a power amplifier 1057 and at least one antenna 1059. The RF transceiver 1055 may also receive RF signals using the one or more antennas 1059.

Figure 11:
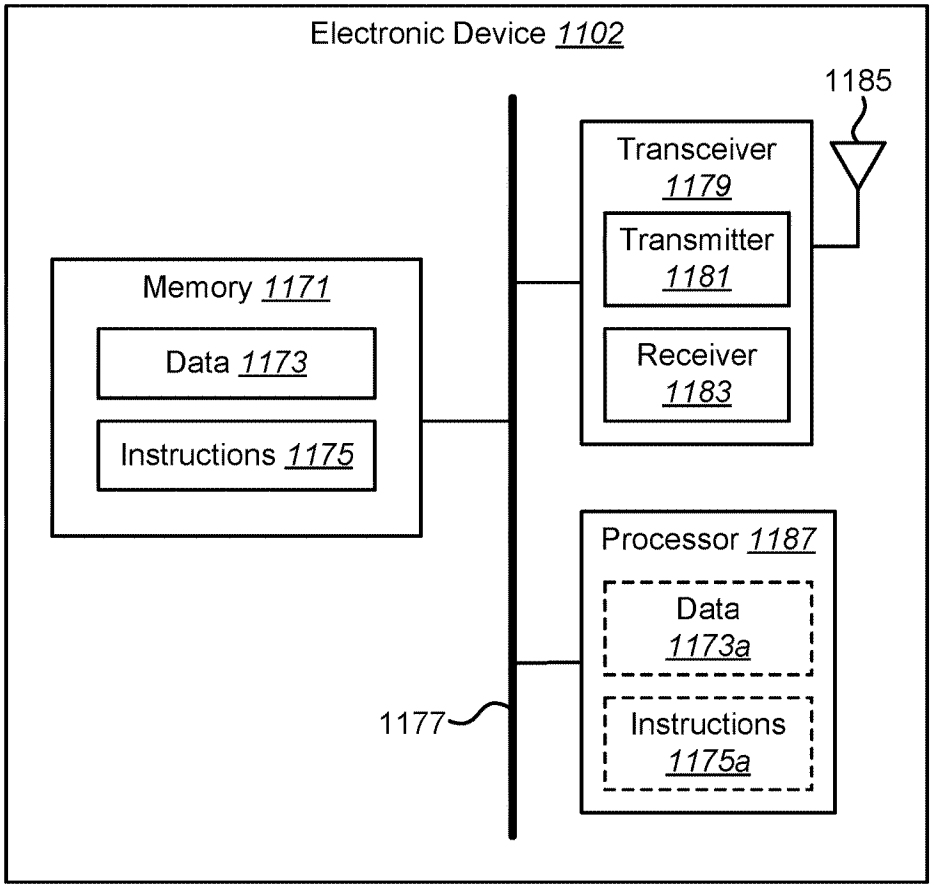
FIG. 11 illustrates certain components that may be included within an electronic device.

FIG. 11 illustrates certain components that may be included within an electronic device 1102. The electronic device 1102 described in connection with FIG. 11 may be an example of and/or may be implemented in accordance with one or more of the electronic devices described herein. For example, the electronic device 1102 may be implemented in accordance with one or more of the electronic device 102, 1302 described herein and/or may be implemented in accordance with one or more of the components described in connection with one or more of FIGS. 1-10.

The electronic device 1102 includes a processor 1187. The processor 1187 may be a general purpose single- or multi-chip microprocessor (e.g., an ARM), a special purpose microprocessor (e.g., a digital signal processor (DSP)), a microcontroller, a programmable gate array, etc. The processor 1187 may be referred to as a central processing unit (CPU). Although just a single processor 1187 is shown in the electronic device 1102 of FIG. 11, in an alternative configuration, a combination of processors (e.g., an ARM and DSP) could be used.

The electronic device 1102 also includes memory 1171 in electronic communication with the processor 1187 (i.e., the processor 1187 can read information from and/or write information to the memory 1171). The memory 1171 may be any electronic component capable of storing electronic information. The memory 1171 may be random-access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1173 and instructions 1175 may be stored in the memory 1171. The instructions 1175 may include one or more programs, routines, sub-routines, functions, procedures, code, etc. The instructions 1175 may include a single computer-readable statement or many computer-readable statements. The instructions 1175 may be executable by the processor 1187 to implement one or more of the methods and/or one or more of the functions, steps, procedures, etc., described herein. Executing the instructions 1175 may involve the use of the data 1173 that is stored in the memory 1171. FIG. 11 shows some instructions 1175*a* and data 1173*a* being loaded into the processor 1187.

The electronic device 1102 may also include a transmitter 1181 and a receiver 1183 to allow transmission and reception of signals between the electronic device 1102 and a remote location (e.g., a wireless communication device, a base station, etc.). The transmitter 1181 and receiver 1183 may be collectively referred to as a transceiver 1179. An antenna 1185 may be electrically coupled to the transceiver 1179. The electronic device 1102 may also include (not shown) multiple transmitters, multiple receivers, multiple transceivers and/or multiple antenna.

The various components of the electronic device 1102 may be coupled together by one or more buses, which may include a power bus, a control signal bus, a status signal bus, a data bus, etc. For simplicity, the various buses are illustrated in FIG. 11 as a bus system 1177.

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing, and the like.

The phrase "based on" does not mean "based only on," unless expressly specified otherwise. In other words, the phrase "based on" describes both "based only on" and "based at least on."

It should be noted that one or more of the features, functions, procedures, components, elements, structures, steps, etc., described in connection with any one of the configurations described herein may be combined with one or more of the functions, procedures, components, elements, structures, steps, etc., described in connection with any of the other configurations described herein, where compatible. In other words, any compatible combination of the functions, procedures, components, elements, etc., described herein may be implemented in accordance with the systems and methods disclosed herein.

The functions described herein may be stored as one or more instructions on a processor-readable or computer-readable medium. The term "computer-readable medium" refers to any available medium that can be accessed by a computer or processor. By way of example, and not limitation, such a medium may comprise Random-Access Memory (RAM), Read-Only Memory (ROM), Electrically Erasable Programmable Read-Only Memory (EEPROM), flash memory, Compact Disc Read-Only Memory (CD-ROM) or other optical disk storage, magnetic disk storage or other magnetic storage devices, or any other medium that can be used to store desired program code in the form of instructions or data structures and that can be accessed by a computer. Disk and disc, as used herein, includes compact disc (CD), laser disc, optical disc, digital versatile disc (DVD), floppy disk, and Blu-ray® disc, where disks usually reproduce data magnetically, while discs reproduce data optically with lasers. It should be noted that a computer-readable medium may be tangible and non-transitory. The term "computer-program product" refers to a computing device or processor in combination with code or instructions (e.g., a "program") that may be executed, processed, or computed by the computing device or processor. As used herein, the term "code" may refer to software, instructions, code, or data that is/are executable by a computing device or processor.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes, and variations may be made in the arrangement, operation, and details of the systems, methods, and apparatus described herein without departing from the scope of the claims.

What is claimed is:

1. A method for refreshing a display panel, comprising:

receiving, at the display panel from post-processing hardware, a look-up table (LUT) based on a histogram of image data and a region of interest (ROI) of the image data;

applying, at the display panel, the LUT to at least a portion of cached data in panel memory to produce modified data, wherein applying the LUT comprises looking up one or more pixel values by the display panel; and refreshing the display panel based on the modified data.

2. The method of claim 1, further comprising:

receiving the image data at the post-processing hardware from system memory;

determining, by the post-processing hardware, a histogram based on the image data;

sending the histogram to an image processing algorithm from the post-processing hardware;

determining, by the image processing algorithm, the LUT; and receiving the LUT at the post-processing hardware.

3. The method of claim 2, wherein the image data is a full frame of image data corresponding to a frame after an initial frame.

4. The method of claim 2, further comprising updating, by the display panel, the cached data based on the ROI.

5. The method of claim 2, wherein the image data received at the post-processing hardware from the system memory is the ROI corresponding to a frame after an initial frame.

6. The method of claim 5, further comprising caching, by the post-processing hardware, the ROI in write back memory.

7. The method of claim 6, wherein the histogram is generated in the write back memory.

8. The method of claim 6, further comprising caching the histogram in the write back memory.

9. The method of claim 8, further comprising updating the histogram for a full frame based on the ROI.

10. The method of claim 1, wherein the ROI is provided by a hardware abstraction layer (HAL).

11. The method of claim 1, further comprising applying, by the post-processing hardware, the LUT to the ROI, and wherein the at least the portion of cached data comprises a non-ROI region of the cached data.

12. An electronic device, comprising:

post-processing hardware; and a display panel configured to receive, from the post-processing hardware, a look-up table (LUT) based on a histogram of image data and a region of interest (ROI) of the image data, to apply the LUT to at least a portion of cached data in panel memory to produce modified data, and to refresh the display panel based on the modified data, wherein the display panel is configured to apply the LUT by looking up one or more pixel values.

13. The electronic device of claim 12, further comprising system memory, wherein the post-processing hardware is configured to:

receive the image data from the system memory;

determine a histogram based on the image data;

send the histogram to an image processing algorithm, wherein the image processing algorithm determines the LUT; and receive the LUT.

14. The electronic device of claim 13, wherein the image data is a full frame of image data corresponding to a frame after an initial frame.

15. The electronic device of claim 13, wherein the display panel is configured to update the cached data based on the ROI.

16. The electronic device of claim 13, wherein the image data received at the post-processing hardware from the system memory is the ROI corresponding to a frame after an initial frame.

17. The electronic device of claim 16, wherein the post-processing hardware is configured to cache the ROI in write back memory.

18. The electronic device of claim 17, wherein the post-processing hardware is configured to generate the histogram in the write back memory.

19. The electronic device of claim 17, wherein the post-processing hardware is configured to cache the histogram in the write back memory.

20. The electronic device of claim 19, wherein the post-processing hardware is configured to update the histogram for a full frame based on the ROI.

21. The electronic device of claim 12, wherein the ROI is provided by a hardware abstraction layer (HAL).

22. The electronic device of claim 12, wherein the post-processing hardware is configured to apply the LUT to the ROI, and wherein the at least the portion of cached data comprises a non-ROI region of the cached data.

23. A computer-program product for refreshing a display panel, comprising a non-transitory tangible computer-readable medium having instructions thereon, the instructions comprising:

code for causing an electronic device to receive, at the display panel from post-processing hardware, a look-up table (LUT) based on a histogram of image data and a region of interest (ROI) of the image data;

code for causing the electronic device to apply, at the display panel, the LUT to at least a portion of cached data in panel memory to produce modified data, wherein the code for causing the electronic device to apply the LUT comprises code for causing the display panel to look up one or more pixel values; and code for causing the electronic device to refresh the display panel based on the modified data.

24. The computer-program product of claim 23, further comprising:

code for causing the electronic device to receive the image data at the post-processing hardware from system memory;

code for causing the electronic device to determine, by the post-processing hardware, a histogram based on the image data;

code for causing the electronic device to send the histogram to an image processing algorithm from the post-processing hardware;

code for causing the electronic device to determine, by the image processing algorithm, the LUT; and code for causing the electronic device to receive the LUT at the post-processing hardware.

25. The computer-program product of claim 24, wherein the image data is a full frame of image data corresponding to a frame after an initial frame.

26. The computer-program product of claim 24, wherein the image data received at the post-processing hardware from the system memory is the ROI corresponding to a frame after an initial frame.

27. An apparatus, comprising:

post-processing means; and display means for receiving, from the post-processing means, a look-up table (LUT) based on a histogram of image data and a region of interest (ROI) of the image data, for applying the LUT to at least a portion of cached data in panel memory means to produce modified data, and for refreshing the display means based on the modified data, wherein the display means for applying the LUT comprises means for looking up one or more pixel values.

28. The apparatus of claim 27, further comprising system memory means, wherein the post-processing means further comprises means for:

receiving the image data from the system memory;

determining a histogram based on the image data;

sending the histogram to an image processing algorithm, wherein the image processing algorithm determines the LUT; and receiving the LUT.

29. The apparatus of claim 28, wherein the image data is a full frame of image data corresponding to a frame after an initial frame.

30. The apparatus of claim 28, wherein the image data received at the post-processing means from the system memory means is the ROI corresponding to a frame after an initial frame.

* * * * *